US008616183B2

(12) United States Patent
Klesse et al.

(10) Patent No.: US 8,616,183 B2
(45) Date of Patent: Dec. 31, 2013

(54) FUEL INJECTION SYSTEM FOR AN INTERNAL COMBUSTION ENGINE

(75) Inventors: Christoph Klesse, Wörth A.D.Donau (DE); Thomas Riedel, Regensburg (DE); Wolfgang Stapf, Karlskron (DE); Björn von Willmann, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 360 days.

(21) Appl. No.: 12/935,343

(22) PCT Filed: Feb. 20, 2009

(86) PCT No.: PCT/EP2009/052046
§ 371 (c)(1),
(2), (4) Date: Sep. 29, 2010

(87) PCT Pub. No.: WO2009/121662
PCT Pub. Date: Oct. 8, 2009

(65) Prior Publication Data

US 2011/0023831 A1 Feb. 3, 2011

(30) Foreign Application Priority Data

Apr. 3, 2008 (DE) ..... 10 2008 017 151

(51) Int. Cl.
*F02M 63/00* (2006.01)

(52) U.S. Cl.
USPC ..... 123/456; 123/458; 73/114.43

(58) Field of Classification Search
USPC ..... 73/114.38, 114.43; 123/468
See application file for complete search history.

(56) References Cited

U.S. PATENT DOCUMENTS

| | | | | |
|---|---|---|---|---|
| 4,714,502 | A * | 12/1987 | Honkura et al. | 148/307 |
| 4,759,842 | A * | 7/1988 | Frees et al. | 210/94 |
| 5,623,907 | A * | 4/1997 | Cotton et al. | 123/456 |
| 5,634,755 | A | 6/1997 | Jones, Jr. | 411/383 |
| 7,004,145 | B2 * | 2/2006 | Zander | 123/456 |
| 2004/0089268 | A1 * | 5/2004 | Brenk et al. | 123/446 |
| 2004/0227299 | A1 * | 11/2004 | Simmons | 277/410 |
| 2007/0006641 | A1 * | 1/2007 | Wiedemann et al. | 73/115 |
| 2010/0280743 | A1 * | 11/2010 | Hehle et al. | 701/103 |

FOREIGN PATENT DOCUMENTS

| | | | | |
|---|---|---|---|---|
| DE | 3231929 | | 3/1984 | B01D 35/06 |
| DE | 19729392 | | 1/1999 | F02M 55/02 |
| DE | 19729392 | A1 * | 1/1999 | |
| DE | 10039425 | A1 | 2/2002 | F02M 55/02 |
| WO | 0214680 | | 2/2002 | F02M 55/02 |

OTHER PUBLICATIONS

International Search Report and Written Opinion for Application No. PCT/EP2009/052046 (11 pages), Jun. 4, 2009.

* cited by examiner

*Primary Examiner* — Stephen K Cronin
*Assistant Examiner* — Elizabeth Hadley
(74) *Attorney, Agent, or Firm* — King & Spalding L.L.P.

(57) ABSTRACT

A fuel injection system for an internal combustion engine has a fuel distributor (2), in the interior space (4) of which is formed a high-pressure accumulator, wherein transverse bores (6) open into the interior space (4). The transverse bores (6) are connected by connecting pipes (8*a*, 8*b*) to pressure lines (10) for the supply and discharge of fuel. A high-pressure sensor (30) is arranged at the face-side end of the fuel distributor (2), which high-pressure sensor (30) is connected by a measurement bore (30*c*) to the interior space (4), and a permanent magnet ring is arranged at that face-side end of the interior space (4) which is assigned to the high-pressure sensor (3).

20 Claims, 3 Drawing Sheets

FUEL INJECTION SYSTEM FOR AN INTERNAL COMBUSTION ENGINE

CROSS-REFERENCE TO RELATED APPLICATIONS

This application is a U.S. National Stage Application of International Application No. PCT/EP2009/052046 filed Feb. 20, 2009, which designates the United States of America, and claims priority to German Application No. 10 2008 017 151.4 filed Apr. 3, 2008, the contents of which are hereby incorporated by reference in their entirety.

TECHNICAL FIELD

The present invention is based on a fuel injection system for an internal combustion engine.

BACKGROUND

Fuel injection systems are known from the prior art, in which the fuel for the injectors assigned to the individual cylinders is centrally provided from a fuel accumulator, also referred to as "common rail". With diesel internal combustion engines, the fuel is compressed here to up to 1800 bar with the aid of a high pressure pump in the common rail.

Here the high pressure pumps, which are embodied for instance as radial or serial piston pumps, are highly mechanically loaded, thereby running the risk of mechanical abrasion developing in the region of the piston which reaches the injection valves by way of the fuel supply line and the fuel accumulator. Modern common rail systems are on the other hand very sensitive to dirt as a result of their very small manufacturing tolerances, e.g. the piston clearance of a common rail high pressure pump amounts to 2 to 4 μm, while the guide clearance of an injection nozzle needle is less than 2 μm.

If a high pressure sensor is arranged on the fuel distributor, there is also the risk here of metallic particles blocking the bore to the measuring surface of the sensor.

Special metallic particles, which either develop as a result of the manufacturing and assembly process or as a result of wear and abrasion of the moving components during the operating time within a common rail system, may result in failure of the system.

For this reason, common rail injection systems of this type are protected by means of various filter systems. For instance, so-called filter cartridges or sieve filters are built into the fuel supply, within the high pressure pump and upstream of the injectors. The aforementioned filters are represented and described for instance in DE 10 2006 014 035 A1. This is disadvantageous in that these filters are limited in terms of their gap size and/or sieve size (e.g. gap size 20 to 40 μm, hole diameter 50 to 80 μm); a finer filtering is not possible as a result of excessively high pressure losses and for cost reasons. Furthermore, the filter would then clog far too quickly, thereby finally resulting in the engine shutting down.

A further filter facility for a high pressure range of an accumulator injection system is known from DE 100 39 425 A1. Here the filter facility is embodied as an end closure of the high pressure pipe and is completely or partially manufactured from a magnetic material.

Laboratory examinations have proved that flow dead zone areas form in the fuel distributor, in which metallic particles preferably deposit. These are preferably embodied on the front ends of the interior and/or the fuel distributor.

If, as described for instance in DE 197 29 392 A1, an end closure of the high pressure pipe is replaced by a high pressure sensor, no magnetic end closure, as known from DE 100 39 425 A1 can be used at this point. Furthermore, the measuring bore of the high pressure sensor is in this case in an afore-described flow dead zone area. As a result, there is an increased risk of interfering with the pressure measurements as a result of dirt or even blockage of the measuring bore.

SUMMARY

According to various embodiments, the filter systems illustrated in the introduction can be improved.

According to an embodiment, a fuel injection system for an internal combustion engine, may comprise a fuel distributor, in the interior of which is embodied a high pressure accumulator, with transverse bores opening into the interior, said transverse bores being connected to pressure lines for the fuel feed and discharge by way of connecting pieces, with at least one element having permanent magnet properties being arranged in the interior of the fuel distributor, wherein a high pressure sensor is arranged on the front end of the fuel distributor, said high pressure sensor being connected to the interior by way of a measuring bore, and that the element with permanent magnet properties is embodied as a permanent magnet ring, which is arranged on the front end of the interior assigned to the high pressure sensor.

According to a further embodiment, the permanent magnet ring can be arranged in a flow dead zone area, embodied at a front end of the interior, of the fuel flowing into and out of the interior.

BRIEF DESCRIPTION OF THE DRAWINGS

Exemplary embodiments are explained in more detail in the following description and drawing, in which.

DETAILED DESCRIPTION

If a high pressure sensor is arranged at the front end of the fuel distributor pipe, said high pressure sensor being connected to the interior of the fuel distributor by way of a measuring bore, a permanent magnet ring arranged at this front end of the interior is proposed, which prevents blockage of the measuring bore with metallic particles.

The use of a permanent magnet ring of this type arranged in the fuel distributor also allows small metallic particles to be bound, so that the risk of a blocked nozzle hole or a clamping injector valve seat or in particular a blocked measuring bore of the high pressure sensor is significantly reduced.

Figure 1:
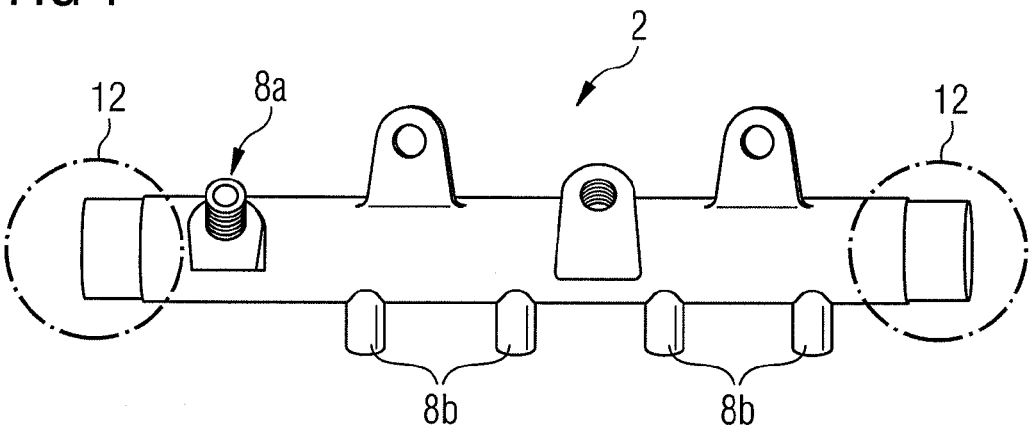
FIG. 1 shows a fuel distributor pipe for a fuel injection system.
Figure 2:
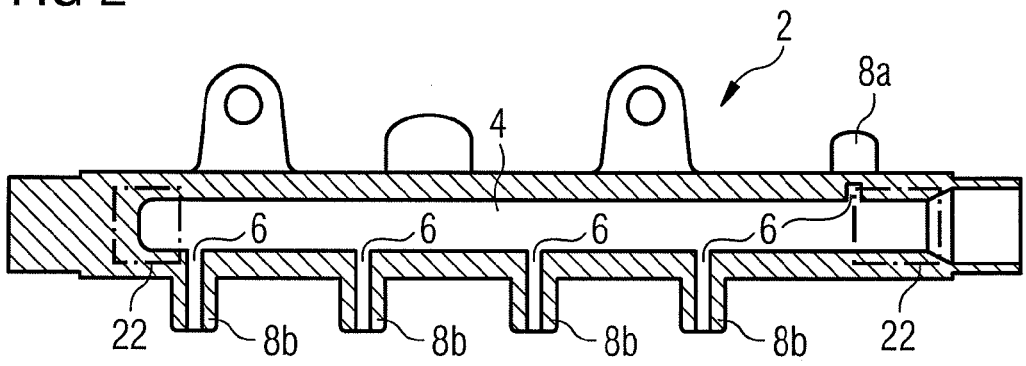
FIG. 2 shows a longitudinal section of the fuel distributor pipe.

The fuel distributor 2 shown in FIGS. 1 and 2 consists of a drawn or rolled pipe. The interior 4 of the fuel distributor 2 embodied as a longitudinal bore forms a high pressure accumulator, into which transverse bores 6 open, which are each connected to a pressure line 10 by way of corresponding connecting pieces 8*a*, 8*b*. A pressure line 10 is used here as a fuel feed of the fuel conveyed by a high pressure fuel pump (not shown), while the remaining pressure lines 10 are connected to a fuel injection valve in each instance.

Figure 3A:
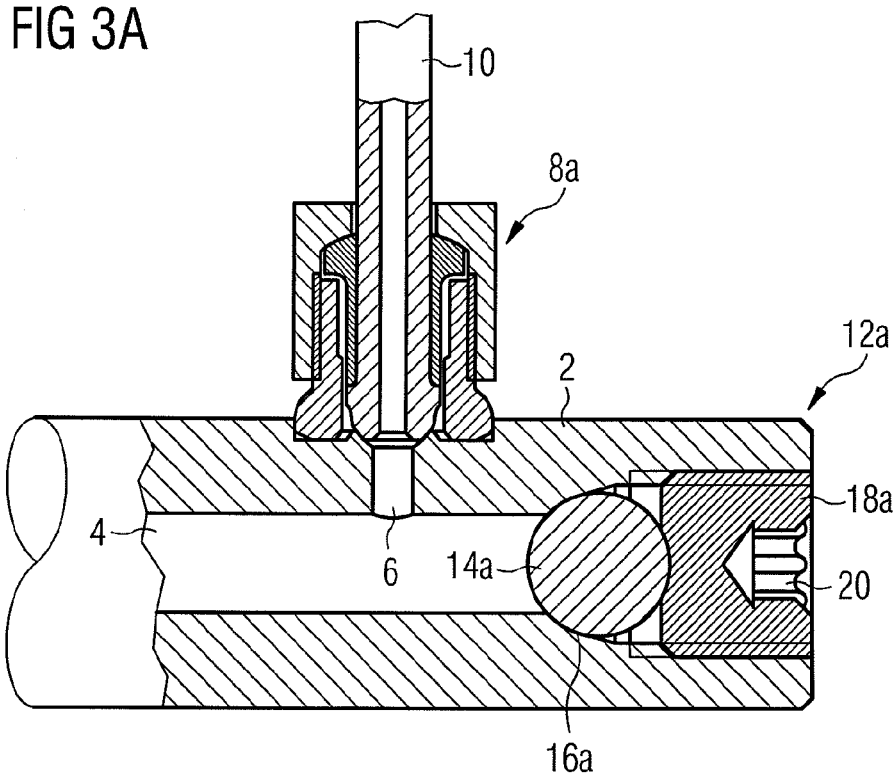
FIG. 3A-3C show different embodiments of magnetic closures, which are arranged at the axial end of a conventional fuel distributor pipe.

As apparent from FIG. 1, the two fronts of the fuel distributor pipe 2 are provided with a closure 12. In a first embodiment according to the prior art (see FIG. 3A), these essentially consist of a spherical sealing element 14*a*, which rests sealingly inside the pipe 2 on a correspondingly adjusted contact surface 16*a*. The sealing element 14*a* is pressed against the contact surface 16*a* by a threaded pin 18*a*, thereby ensuring a tight closure of the interior 4 embodied as a high pressure accumulator. The threaded pin 18*a* is screwed in with the aid of an insertion opening 20 provided for a screwing tool.

The closure 12*a*, consisting of the sealing element 14*a* and threaded pin 18*a*, consists for instance of a metallic alloy, which is embodied as a permanent magnet. The metallic particles thus collecting in the so-called (fuel flow) dead zone areas 22 (see FIG. 2) can thus be permanently bound and there is no risk of the injectors and/or injection valves thus being contaminated.

Figure 3B:
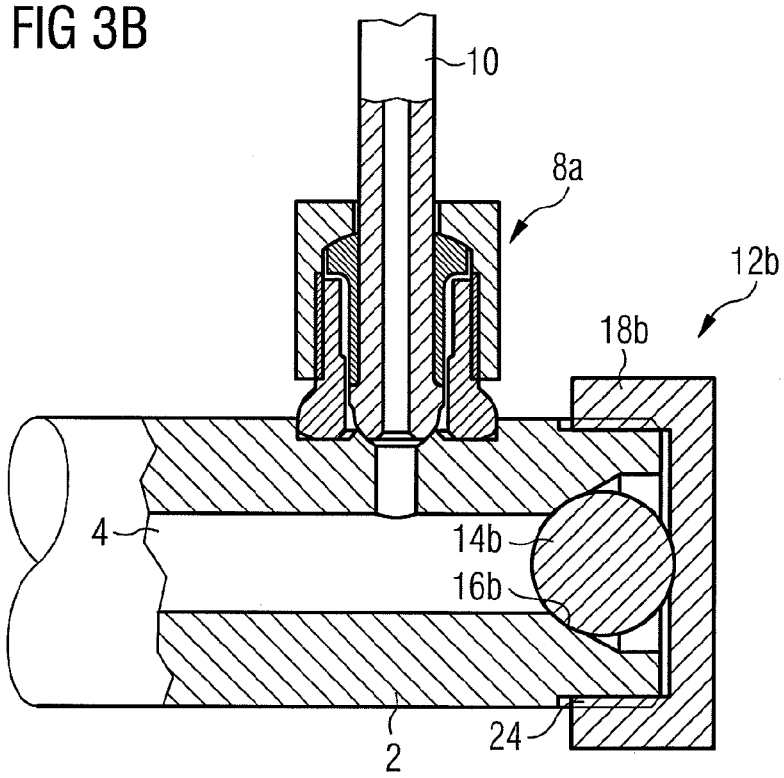

In a second embodiment according to the prior art, see FIG. 3B, the closure 12*b* is in turn made of a spherical sealing element 14*b*, which is in this case pressed against the contact surface 16*b* with the aid of a threaded cap 18*b*. The threaded cap 18*b* is in this way screwed onto an outer thread 24 attached to the fuel distributor pipe 2. The closure 12*b* is also embodied here as a permanent magnet, in order, similarly to the first exemplary embodiment, to bind metallic particles and/or metallic abrasion.

Figure 3C:
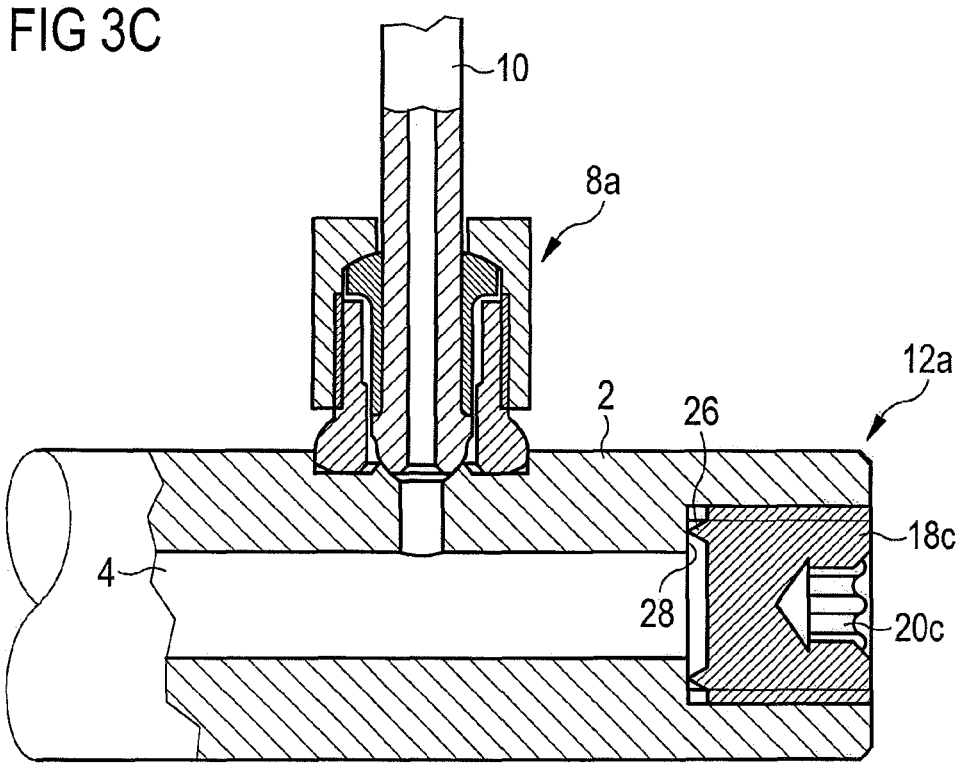

In a third embodiment according to the prior art, see FIG. 3C, a separate sealing element has been dispensed with; the closure 12*c* embodied as a permanent magnet, consists, similarly to the subject matter disclosed in DE 100 39 425 A1, of a threaded pin 18*c*, which is also provided with a so-called biting edge 26 on its side facing the interior 4, said biting edge being braced against a front surface 28 of the fuel distributor pipe 2 as a linear contact and thus ensuring the sealing of the high pressure interior 4.

Other embodiments for the magnetic closure 12 are naturally also conceivable, the threaded pin 18 can be embodied spherically on its front side facing the interior and can interact in a sealing fashion with a correspondingly concave molded front surface in the fuel distributor pipe 2.

Figure 4:
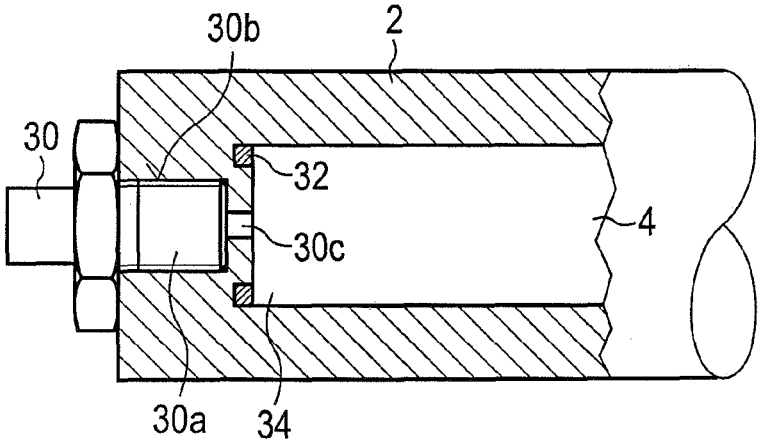
FIG. 4 shows a high pressure sensor arranged at the axial end of the fuel distributor pipe, with a permanent magnet ring according to an embodiment.

In one embodiment, as shown in FIG. 4, the closure 12 is embodied as a high pressure sensor 30 arranged on the front side of the fuel distributor pipe 2. The high pressure sensor 30 comprises a threaded part 30*a*, which is screwed into a bore 30*b* provided with an inner thread. The bore 30*b* is embodied as a tapped blind hole bore, with a further bore 30*c*, which has a reduced diameter, being provided to detect the pressure prevailing in the interior 4, by means of which bore 30*c* a connection is established between the interior 4 and the tapped blind hole bore 30*b*. A permanent magnet ring 32 is arranged on the front side end of the interior 4, said permanent magnet ring 32 being placed into an annular groove embodied accordingly in the fuel distributor pipe 2. Metallic particles 34 can be bound by means of the permanent magnet ring 32 and are thus kept away from the measuring bore 30*c*.

What is claimed is:

1. A fuel injection system for an internal combustion engine, comprising:

a fuel distributor, a high pressure accumulator embodied in an interior of the fuel distributor and comprising transverse bores opening into the interior, said transverse bores being connected to pressure lines for a fuel feed and discharge by way of connecting pieces, with at least one element having permanent magnet properties being arranged in the interior of the fuel distributor, a high pressure sensor arranged on the front end of the fuel distributor, said high pressure sensor being connected to the interior by way of a measuring bore, and wherein the element with permanent magnet properties is embodied as a permanent magnet ring, which is arranged on the front end of the interior assigned to the high pressure sensor, wherein the permanent magnet ring is arranged in an annular groove or recess such that a single magnetic surface of the permanent magnet ring is openly exposed to the interior of the fuel distributor, the openly exposed magnetic surface defining a plane that extends generally perpendicular to a direction of fuel flow through the measuring bore and being configured to attract and collect magnetic particles present in the interior of the of the fuel distributor.

2. The fuel injection system according to claim 1, wherein the permanent magnet ring is arranged in a flow dead zone area, embodied at a front end of the interior, of the fuel flowing into and out of the interior.

3. A fuel injection system for an internal combustion engine, comprising:

a fuel distributor, wherein a high pressure accumulator is formed by an interior of the fuel distributor which comprises transverse bores opening into the interior, said transverse bores being connected to pressure lines for a fuel feed and discharge, a high pressure sensor arranged on a front end of the fuel distributor, said high pressure sensor being connected to the interior by way of a measuring bore, and a permanent magnet ring arranged on the front end of the interior assigned to the high pressure sensor, wherein the permanent magnet ring is arranged in an annular groove or recess such that a single magnetic surface of the permanent magnet ring is openly exposed to the interior of the fuel distributor, the openly exposed magnetic surface defining a plane that extends generally perpendicular to a direction of fuel flow through the measuring bore and being configured to attract and collect magnetic particles present in the interior of the of the fuel distributor.

4. The fuel injection system according to claim 3, wherein the permanent magnet ring is arranged in a flow dead zone area, embodied at the front end of the interior, of the fuel flowing into and out of the interior.

5. The fuel injection system according to claim 3, wherein the fuel distributor consists of a drawn or rolled pipe.

6. The fuel injection system according to claim 3, wherein at least one of said transverse bores is connected to a fuel injection valve.

7. The fuel injection system according to claim 3, wherein said fuel distributor comprises a second front end which is provided with a second closure.

8. The fuel injection system according to claim 7, wherein the second closure consist of a spherical sealing element, which rests sealingly inside the interior on a correspondingly adjusted contact surface.

9. The fuel injection system according to claim 8, wherein the sealing element is pressed against the contact surface by a threaded pin, thereby ensuring a tight closure of the interior.

10. The fuel injection system according to claim 9, wherein the threaded pin is screwed in with the aid of an insertion opening provided for a screwing tool.

11. The fuel injection system according to claim 7, wherein the second closure consists of a metallic alloy, which is embodied as a permanent magnet.

12. The fuel injection system according to claim 8, wherein the second closure comprises a spherical sealing element, which is pressed against a contact surface with the aid of a threaded cap which is screwed onto an outer thread of the fuel distributor.

13. The fuel injection system according to claim 8, wherein the second closure is embodied as a permanent magnet.

14. The fuel injection system according to claim 13, wherein the second closure is a threaded pin.

15. The fuel injection system according to claim 14, wherein the threaded pin comprises a biting edge on its side facing the interior.

16. The fuel injection system according to claim 15, wherein the biting edge being braced against the front surface of the fuel distributor as a linear contact and thus ensuring the sealing of the interior.

17. The fuel injection system according to claim 12, wherein the threaded pin is embodied spherically on its front side facing the interior interacts in a sealing fashion with a correspondingly concave molded front surface in the fuel distributor.

18. The fuel injection system according to claim 3, wherein the high pressure sensor forms a first closure arranged on a front side of the fuel distributor, wherein the high pressure sensor comprises a threaded part, which is screwed into a bore provided with an inner thread.

19. The fuel injection system according to claim 18, wherein the bore is embodied as a tapped blind hole bore, and further comprising a further bore, which has a reduced diameter, being provided to detect the pressure prevailing in the interior.

20. A fuel injection device, comprising:

a fuel distributor including transverse bores opening into an interior of the fuel distributor, said transverse bores being connected to pressure lines for a fuel feed and discharge, a high pressure sensor arranged on a front end of the fuel distributor, said high pressure sensor being connected to the interior via a measuring bore, and a permanent magnet ring arranged on the front end of the interior assigned to the high pressure sensor, wherein the permanent magnet ring is arranged in an annular groove or recess such that an only exposed magnetic surface of the permanent magnet ring defines a plane that extends generally perpendicular to a direction of fuel flow through the measuring bore and being configured to attract and collect magnetic particles present in the interior of the of the fuel distributor.

* * * * *